United States Patent [19]

Pellation

[11] 4,017,018

[45] Apr. 12, 1977

[54] CARTON CLOSURE

[75] Inventor: Ernest C. Pellation, Larkspur, Calif.

[73] Assignee: Fibreboard Corporation, San Francisco, Calif.

[22] Filed: Mar. 29, 1976

[21] Appl. No.: 671,624

[52] U.S. Cl. ..... 229/39 R

[51] Int. Cl.[2] ..... B65D 5/10

[58] Field of Search ..... 229/39 R, 37 R

[56] References Cited

UNITED STATES PATENTS

| | | | |
|---|---|---|---|
| 3,074,613 | 1/1963 | Cupo | 229/39 R |
| 3,580,477 | 5/1971 | Roth | 229/39 R |
| 3,770,187 | 11/1973 | Faires | 229/39 R |
| 3,871,571 | 3/1975 | Cupo | 229/37 R X |

*Primary Examiner*—Davis T. Moorhead
*Attorney, Agent, or Firm*—Robert A. Beck

[57] ABSTRACT

A carton closure is formed with cutaway areas at side edges of the minor flaps and the inner major flap, arranged so that when in the closed position portions of the minor flaps underlie the inner major flap and portions of the inner major flap underlie the minor flaps to prevent racking of the carton during filling and sealing and to provide back-up resistance during sealing operations.

3 Claims, 8 Drawing Figures

CARTON CLOSURE

BACKGROUND OF THE INVENTION

The present day packaging of products such as raisins, detergents, cereals and the like in cartons employs sophisticated, high speed machinery. This machinery is quite efficient, but the problem of carton "racking" during filling and sealing causes frequent troubles. The cartons used in these operation have a top closure of rectangular configuration; that is, when viewed from above, the top closure forms a perfect rectangle. However, frequently the high speed handling causes the cartons to rack and this rectangular configuration is distorted causing sealing problems and unsightly appearance. A second problem arises when the outer major flap is folded over and sealed to the underlying flaps by glue, preapplied adhesive, hot melt or other means. Due to the high speed operations, pressure can be applied to the folded outer major flap for only a very short time. Conventional inner flaps have little inherent rigidity and will bend inwardly when pressure is applied to prevent a tight seal of the closure. Interacting cut areas at the side edges of the inner flaps will correct racking which may have occurred during handling and filling and will prevent further racking during folding and sealing, while the intermeshing of these same inner flaps will provide rigidity during sealing to give better, tighter seals.

PRIOR ART

1. Cupo U.S. Pat. No. 3,074,613, class 229–39, discloses slots within the body of the inner major flap and tabs on the minor flaps which fit into the slots to provide backup pressure during sealing.

2. Roth Pat. No. 3,580,477, class 229–39, discloses tabs on the minor flaps which fit into rectangular areas cut out of the interior of the inner major flap to prevent racking during carton sealing.

In forming the paperboard blanks to be used in the cartons of both of the foregoing disclosures, serious difficulties are encountered in cutting and stripping the material from the slots cut within the interior of the inner major flaps. Further, each of these structures requires very precise flap control during folding to direct the tabs on the minor flaps into the slots. Even slight control variations, frequently encountered in high speed operations, will cause the tabs to miss the slots within the flap and the invention will not function. The present invention overcomes both of these problems. Cutaway portions at edges of the flaps are easily cut and stripped out and intermeshing of these areas during folding does not require the aforementioned precise control.

SUMMARY OF THE INVENTION

An object of this invention is to overcome the above briefly described problems of racking during carton set up and sealing and of poor seals due to lack of back-up pressure during carton sealing by a unique closure for the end of a carton.

In the preferred embodiment, the closure is used on a tubular paperboard carton of rectangular configuration. The carton comprises a pair of side walls, a front wall and a back wall joined innto tubular shape by a manufacturer's flap. The closure comprises a pair of minor flaps hinged to the side walls, an inner major flap hinged to the front wall and an outer major flap hinged to the back wall.

The side edges of the minor flaps and the inner major flap are cut away so that either both minor flaps or both sides of the inner major flap having a protruding portion thereon, while the others of these two have a cutout forming an angle extending into the flap or flaps. When these flaps are closed, the two protruding portions intermesh with the adjacent angled cutouts so that a part of each minor flap overlies the inner major flap and a part of the inner major flap overlies each minor flap. This intermeshing prevents racking and provides back-up pressure for sealing the outer major flap to the inner flaps.

BRIEF DESCRIPTION OF THE DRAWINGS

Other objects of this invention will become apparent from the following description and accompanying drawings wherein.

DETAILED DESCRIPTION

Figure 1:
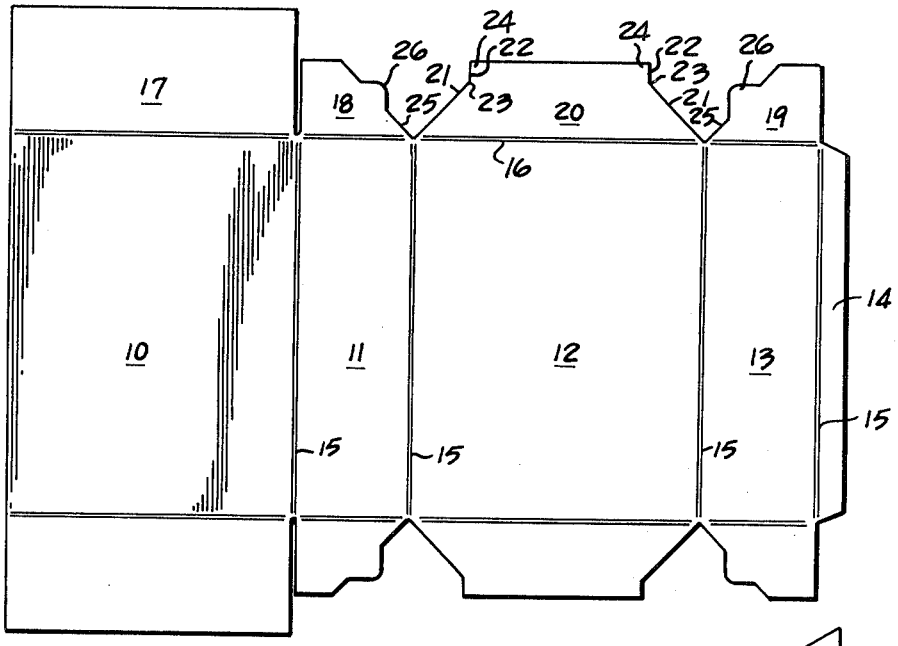
FIG. 1 is a plan view of a paperboard blank adapted to be erected into a carton embodying the invention.

A carton utilizing the preferred embodiment of the invention may be formed from the blank of FIG. 1. The blank of FIG. 1 comprises a back panel 10, side panels 11, 13 front panel 12 and manufacturer's flap 14 all hingedly connected along parallel scorelines, 15. The closure flaps are hinged to these panels along a common scoreline 16 which is perpendicular to scorelines 15. These closure flaps include an outer major flap 17, hinged to back panel 10, minor flaps 18, 19 hinged to side panels 11, 13 and an inner major flap 20 hinged to the front panel 12. The bottom closure of the blank may be identical to the top closure, as shown, or, if desired, may be formed from conventional rectangular flaps.

The inner major flap 20 is formed with diagonally cut side edges, 21, 21, extending inwardly toward the free outer edge thereof. As shown in the drawing, these diagonally cut edges 21 commence at the junctures of the side edges of flap 20 with panel 12. It should be understood, however, that if desired the side edges of inner major flap 20 may extend vertically upwardly a short distance before the said diagonal cut edge commences. Diagonally cut edges 21, 21, meet perpendicularly cut edges 22, 22 of the inner major flap to form angles, 23, 23, extending inwardly of the flap, with these angles opening outwardly toward the adjacent minor flaps. Angles 23, 23 are so positioned that when the inner flaps are folded into sealing position the vertices of angles 23 will be in point contact with the extensions of cut edges 25, 25 in minor flaps 18, 19 to prevent racking. Free corners 24, 24, are formed where perpendicularly cut edges 22, 22, meet the free edge of inner major flap 20.

Minor flaps 18 and 19 are essentially mirror images of each other so the structure of only one will be described. The edge of minor flap 18 adjacent to inner major flap 20 is cut away diagonally inwardly along edge 25. As noted above with respect to cut side edge 21 of inner major flap 20, the side edges of minor flap 18 may also extend vertically upwardly a short distance before the diagonal cut edge 25 commences if desired. Medially of diagonally cut edge 25, a protruding portion 26 extends outwardly toward inner major flap 20. The edge of minor flap 19 adjacent to inner major flap 20 is formed in a similar manner.

To form a carton from the blank of FIG. 1, the blank is suitably folded along selected ones of foldlines 15 so that manufacturer's flap 14 may be sealed to the inner surface of back panel 10 to form a flattened tubular carton structure. The carton may then be squared up into the form shown in FIG. 2 and is then ready for filling.

Figure 2:
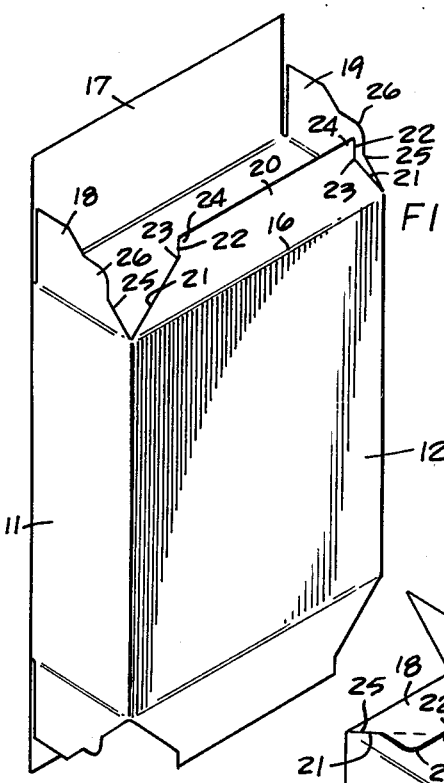
FIG. 2 is a perspective view of a tubular carton formed from the blank with the closure in open configuration.

The carton of FIG. 2 is filled and sealed in the following manner. First the bottom closure flaps are folded and sealed to form the bottom closure. If these flaps are conventional, rectangular flaps, they may be folded and sealed in the conventional manner. If they are similar to the top closure flaps, as shown in FIG. 2, they may be folded and sealed similarly to the following description of the folding and sealing of the top closure. Upon completion of the bottom closure, the contents to be packaged in the carton are inserted and the carton is then ready for closing and sealing of the top closure.

Figure 3:
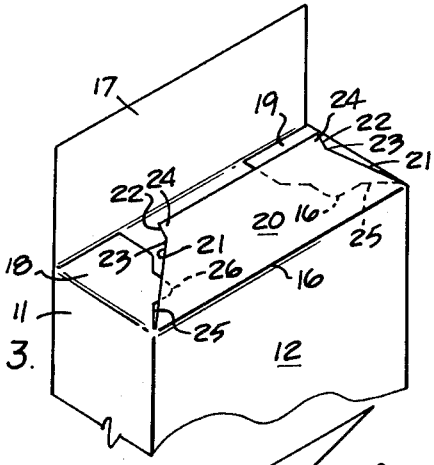
FIG. 3 is a view similar to FIG. 2 with the inner flaps partially folded but not intermeshed.
Figure 4:
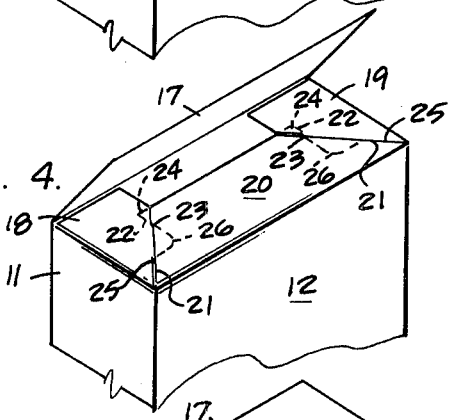
FIG. 4 is a view similar to FIG. 3 after intermeshing of the inner flaps.
Figure 5:
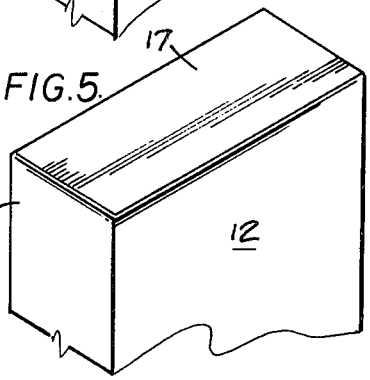
FIG. 5 is a perspective of the completely closed carton.

The preferred method and arrangement of the top closure is shown in FIGS. 3 to 5. As shown, the first step is to fold minor flaps 18 and 19 inwardly to a position inclined 90° to the side panels 11, 13, to which said flaps are attached. Thereafter, inner major flap 20 is folded inwardly 90° into contact with said minor flaps. In this position, the flaps are essentially similar in placement to a conventional carton closure and provide no back-up support for sealing nor do they prevent racking.

To incorporate into the closure the anti-racking feature and the back-up pressure for sealing, an inward force is applied to the free edge of inner major flap 20, forcing it and minor flaps 19, 19 inwardly of the carton. This force may be applied by a suitably arranged plow or other means. As these flaps are forced inwardly to a certain point, free corners, 24, 24 on the inner major flap snap under the outer extensions of cut edges 25, 25 of minor flaps 18, 19. Upon release of this force, the natural resiliency of the flaps causes them to spring back into the position shown in FIG. 4 where they are intermeshed to provide anti-racking and back-up sealing features.

As shown in FIG. 4, when the inner flaps are in this position, protruding portions 26, 26 on minor flaps 18, 19, underlie inner major flap 20 along cut edges 21, 21 and thereby provide back-up support to the inner major flap during sealing while simultaneously free corners 24, 24 of inner major flap 20 underlies minor flaps 18, 19 along the extensions of cut edges 25, 25 to provide back-up support to the minor flaps 18, 19. This intermeshing action of these flaps in which each, in part, underlies and supports the other, provides substantial back-up pressure during sealing and permits excellent seals to be obtained even at rapid speeds.

Another benefit derived from this intermeshing of these inner flaps is the aforementioned anti-racking feature. As is shown in FIG. 4, the point at the apex of each angle 23, 23, cut into inner major flap 20 is in contact with the extension of each cut edge 25, 25 of minor flaps 18, 19. If pressures are exerted on the carton during handling and processing which tend to distort the closure out of its rectangular form, the pressure exerted by these points at the apices of the angles 23, 23 upon cut edges 25, 25 will resist and prevent this distortion. It can thus be seen that the closure design will promote excellent and complete seals and will also prevent carton distortion frequently encountered in high speed carton sealing.

It should also be noted that there is yet another feature shown in FIGS. 1–4 which promotes tight carton seals. Cut edges 21, 21 of inner major flap 20 and cut edges 25, 25 of minor flaps 18, 19 may be formed at specified angles, such that when these flaps are folded inwardly in position for sealing, there is only edge contact along the flap junctures 21, 25 and 21, 25 with no overlapping of these flaps in the areas adjacent the hinge lines of the flaps. Since these areas close to the flap hinge lines are the areas where the closure will normally be sealed, this feature permits smooth, unbroken contact with outer major flap 17 in the sealing area when this flap is folded into sealing position, and when sealing pressure is exerted on outer major flap 17, no portions of the inner flaps in the sealing area contain a change from a double layer of paperboard to a single layer of paperboard. Thus, these changes from a double to a single layer of paperboard which create cracks and fissures in the seal are eliminated.

Figure 6:
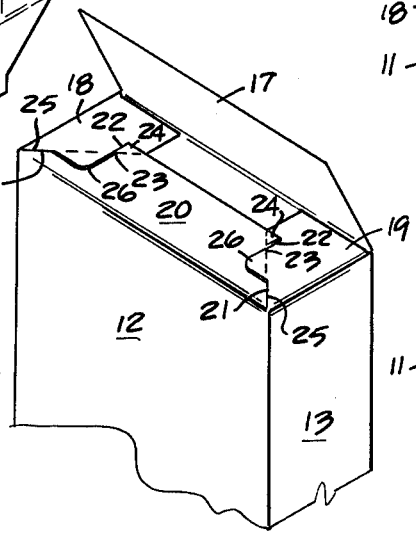
FIG. 6 is a view similar to FIG. 4 showing an alternative closed configuration of the inner flaps.

An alternative form of this closure is shown in FIG. 6. Contrary to the previous form wherein minor flaps 18, 19 were folded inwardly first, then inner major flap 20 was folded inwardly and pressure was exerted on inner major flap 20 to snap free corners 24, 24 under the extensions or cut edges 25, 25 on minor flaps 18, 19, in this form of the closure, minor flaps 18, 19 and inner major flap 20 are folded inwardly simultaneously. This results in what is essentially a reversed intermeshing of these flaps as shown in FIG. 6, wherein protruding portions 26, 26 of minor flaps 18, 19, overlie cut edges 21, 21 of inner major flap 20, and free corners 24, 24 of inner major flap 20 overlie the extensions of cut edges 25, 25 of minor flaps 18, 19. As can be seen, forming the closure in this manner provides all the benefits and advantages of that disclosed previously.

Figure 7:
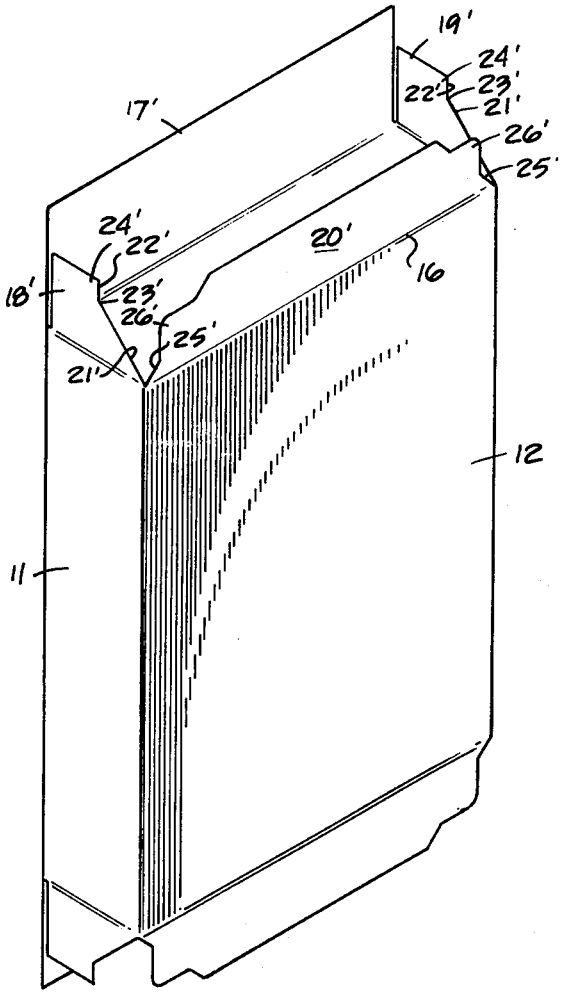
FIG. 7 is a view similar to FIG. 2, showing a second embodiment of the invention.
Figure 8:
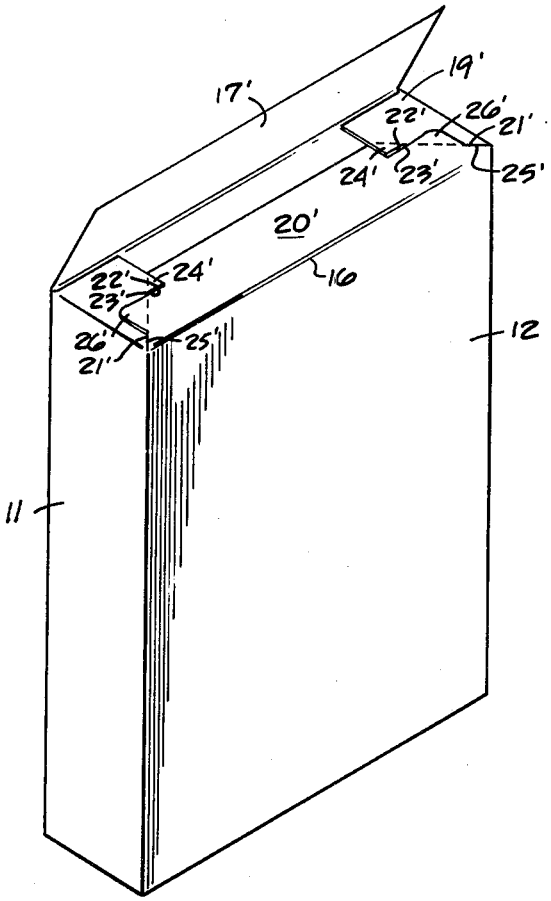
FIG. 8 is a perspective view of this embodiment with the inner flaps folded and intermeshed.

A second embodiment of the invention is shown in FIGS. 7–8. This embodiment may be regarded as essentially a reversal of parts of that previously disclosed. In other words, protruding portions 26, 26, previously shown on minor flaps 18, 19, are now formed on inner major flap 20 and angles 23, 23 and free corners 24, 24 previously shown on inner major flap 20 are now on the minor flaps. Expressed in more detail, and referring to FIG. 7, 8, the side edges of inner major flap 20' are cut away diagonally inwardly along cut edges 25', 25'. Medially of each diagonally cut edge 25', 25' a protruding portion 26' extends outwardly toward the adjacent minor flap. In this embodiment, the minor flaps 18', 19' are essentially mirror images of each other so the structure of only one will be described. Minor flap 18' is formed with the side edge adjacent inner major flap 20' cut away diagonally inwardly to form diagonally cut edge 21' extending toward the free outer edge of the flap. A second cut edge 22', extending inwardly from the free outer edge of flap 18' intersects cut edge 21' to form angle 23' extending inwardly of flap 19, with angle 23' opening outwardly toward adjacent inner major flap 20'. Angle 23' is so positioned that when the inner flaps are folded into sealing position the vertex of angle 23' will be in point contact with the extension of cut edge 25' of inner major flap 20' to prevent racking. Free corner, 24', is formed on minor flap 18' where cut edge 22' meets the free outer edge thereof.

The closure of this embodiment may be formed by simultaneous folding of the minor flaps and the inner major flap, so that protruding portions 26', 26' will overlie cut edges 21', 21', and free corners 24', 24' will overlie the extensions of cut edges 25', 25'. This closure as shown in FIG. 7, 8 has all the benefits of the first embodiment, and the closure may be completed by folding outer major flap 17' into closing position and then sealing in any usual manner.

In another method of forming the closure of this embodiment, inner major flap 20' is first folded inwardly perpendicular to the front wall into closure position. Minor flaps 18', 19' are then folded inwardly to overlie inner major flap 20'. Pressure is then applied to free outer edges of the minor flaps until free corners 24', 24' snap under the extensions of cut edges 25', 25' of inner major flap 20'.

Although the drawings all disclose that inner major flaps 20 and 20' are cut off at the free edge thereof remote from the flap scoreline 16, it should be understood that these flaps may, if desired, extend the full width of the carton.

As can be seen from the foregoing, several versions are disclosed of a carton closure which provides several advantages over conventional closures. By forming the minor flaps and the inner major flap with specified cut edges adjacent each other a closure may be formed in which the minor flaps and the inner major flap intermesh with each other to prevent racking of the carton during filling and sealing operation and to provide back-up pressure during sealing.

I claim:

1. A closure for a carton, said carton comprising a front wall, a back wall, a pair of side walls, a bottom closure and a top closure, said top closure formed so that the inner flaps thereof intermesh with each other to provide support during sealing operations and thus promote a tight seal, said top closure comprising a pair of minor flaps hinged to the side walls, an inner major flap hinged to the front wall and an outer major flap hinged to the back wall, said minor flaps and said inner major flap folded inwardly at 90° angles to the respective walls to which they are hinged and said outer major flap folded over into contact with and sealed to said minor flaps and said inner major flap to form said top closure, first cutaway side edges on sides of said inner major flap adjacent said minor flaps, and second cutaway side edges on each minor flap on a side thereof adjacent said inner major flap, said cutaway edges on one of (a) said minor flaps and (b) said inner major flap, comprising first cuts extending from the side edges thereof adjacent hingelines connecting said flaps to the carton walls diagonally upwardly and inwardly to the free outer edge thereof, and protruding portions formed medially of said cutaway edges, and the cutaway edges on the other of said flaps comprising second cuts extending from the side edges thereof adjacent hingelines connecting said flaps to the carton walls diagonally inwardly and upwardly toward outer free edges thereof, third cuts extending from points on an outer free edge thereof generally perpendicularly downwardly to intersect said second cuts and form angles therewith having vertices at said intersections, the intersections of said third cuts and said outer free edges forming free corners, said protruding portions and said free corners comprising means which intermesh when said flaps are in folded position so that portions of said minor flap overlie said inner major flap and portions of said inner major flap overlie said minor flaps, thereby providing support for said flaps during sealing of said outer major flap thereto.

2. The carton closure of claim 1, further comprising point contacts between said vertices and said cutaway edges, said point contacts resisting distortion of the configuration of the closure during sealing operations.

3. The carton closure of claim 1, wherein said protruding portions are formed on said minor flaps and said free corners are formed on said inner major flap and when said closure is in closed position ready for sealing, said protruding portions overlie said inner major flap and said free corners overlie said minor flaps.

* * * * *